US011117691B2

(12) United States Patent
Gasparini et al.

(10) Patent No.: US 11,117,691 B2
(45) Date of Patent: Sep. 14, 2021

(54) AUTOMATIC PACKAGING MACHINE

(71) Applicant: SMIPACK S.p.A., Bergamo (IT)

(72) Inventors: Marco Gasparini, Bergamo (IT); Luca Pianetti, Bergamo (IT)

(73) Assignee: Smipack S.p.A., Bergamo (IT)

( * ) Notice: Subject to any disclaimer, the term of this patent is extended or adjusted under 35 U.S.C. 154(b) by 278 days.

(21) Appl. No.: 16/257,865

(22) Filed: Jan. 25, 2019

(65) Prior Publication Data

US 2019/0276168 A1 Sep. 12, 2019

(30) Foreign Application Priority Data

Mar. 9, 2018 (IT) ..... 102018000003391

(51) Int. Cl.

| | |
|---|---|
| ***B65B 5/04*** | (2006.01) |
| ***B65B 11/08*** | (2006.01) |
| ***B65B 35/24*** | (2006.01) |
| ***B65B 5/06*** | (2006.01) |
| ***B65B 57/12*** | (2006.01) |
| ***B65B 9/073*** | (2012.01) |
| ***B65B 41/18*** | (2006.01) |
| ***B65B 41/16*** | (2006.01) |

(52) U.S. Cl.

CPC ..... *B65B 5/045* (2013.01); *B65B 5/061* (2013.01); *B65B 9/073* (2013.01); *B65B 11/08* (2013.01); *B65B 35/24* (2013.01); *B65B 41/16* (2013.01); *B65B 41/18* (2013.01); *B65B 57/12* (2013.01)

(58) Field of Classification Search

None

See application file for complete search history.

(56) References Cited

U.S. PATENT DOCUMENTS 4,519,185 A * 5/1985 Horn ..... B65B 9/06 493/302
4,939,889 A * 7/1990 Watanabe ..... B26F 3/08 53/450

(Continued)

FOREIGN PATENT DOCUMENTS

DE 19824044 A1 12/1992
EP 1044881 A2 10/2000

*Primary Examiner* — Hemant Desai
*Assistant Examiner* — Tanzim Imam
(74) *Attorney, Agent, or Firm* — Henry J. Cittone; Cittone Demers & Arneri, LLP

(57) ABSTRACT

An automatic packaging machine, comprising an input conveyor belt, a reel holder, containing a reel of single-fold film, a contoured shaped film former, a sealing bar, a collecting device, an output conveyor belt, and a pulling device with at least an upper driving wheel and a lower driving wheel in contact with a layer of single-fold film interposed between said wheels which, rotating in opposite directions, move the single-fold film along the automatic packaging machine; a drive shaft, which transfers a rotational motion to the driving wheels to move the single-fold film along the automatic packaging machine; a lifting actuator, which moves the upper driving wheel away from the lower driving wheel (or vice versa) when sealing the single-fold film, so as to reduce the tension exerted by the driving wheels on the single-fold film during the sealing step and having a lifting actuator actuated by the drive shaft.

13 Claims, 9 Drawing Sheets

(56) References Cited

U.S. PATENT DOCUMENTS

| | | | | | |
|---|---|---|---|---|---|
| 5,367,859 | A * | 11/1994 | Suga | B65B 9/067 | 53/374.6 |
| 5,566,526 | A * | 10/1996 | Suga | B65B 9/067 | 53/389.4 |
| 5,603,202 | A * | 2/1997 | Hanagata | B65B 9/073 | 53/228 |
| 5,941,052 | A * | 8/1999 | Evangelisti | B65B 9/067 | 53/433 |
| 6,662,527 | B1 * | 12/2003 | Suga | B29C 65/18 | 53/374.6 |
| 2004/0083688 | A1 * | 5/2004 | Limousin | B65B 53/063 | 53/442 |
| 2004/0128957 | A1 * | 7/2004 | Guzman | B29C 65/224 | 53/550 |
| 2004/0226267 | A1 * | 11/2004 | Mansuino | B65B 9/067 | 53/450 |
| 2008/0047232 | A1 * | 2/2008 | Kovacs | B65B 25/145 | 53/450 |
| 2009/0255219 | A1 * | 10/2009 | Honegger | B65H 29/042 | 53/447 |
| 2020/0207500 | A1 * | 7/2020 | Kalinowski | B65B 57/06 | |

* cited by examiner

AUTOMATIC PACKAGING MACHINE

CROSS-REFERENCE TO RELATED APPLICATION

This application claims priority to Italian Patent App. No. 102018000003391 filed Mar. 9, 2018 the disclosure of which is incorporated by reference herein in its entirety.

FIELD OF THE INVENTION

The present invention relates to an automatic packaging machine.

BACKGROUND

Automatic packaging machines allow single products or groups of products to be bagged in a single film pack, for example, single-fold film. Packaging machines allow different types of products to be packed for various market sectors, for example, paper goods, graphic design, information technology, household, toys, cosmetics, plastics, wood, paper, engineering, box factories, shelving.

Automatic packaging machines of the prior art generally comprise:

- an input conveyor belt, onto which the product (or the group of products) intended for packaging is loaded;
- a reel holder, containing a single-fold film reel, which feeds the automatic packaging machine by unwinding a single-fold film;
- a film former having a contoured shape, which deploys the single-fold film, separating the two edges of single-fold film, originally folded one on top of the other, in order to wind it around the product to be packaged;
- a sealing bar, which seals the single-fold film around the product by sealing the still-open sides of single-fold film;
- a collecting device for the scraps of single-fold film;
- an output conveyor belt, which moves the product away from the automatic packaging machine, once the packaging has been completed;
- a pulling device for the single-fold film, comprising:
- at least two driving wheels, in particular, an upper driving wheel and a lower driving wheel, in contact with a layer of single-fold film interposed between the two driving wheels and which, rotating in opposite directions, move the single-fold film along the automatic packaging machine;
- a drive shaft, which transfers a rotational motion to the driving wheels, so that the driving wheels move the single-fold film along the automatic packaging machine;
- a lifting actuator actuated by an external circuit (generally a pneumatic or hydraulic circuit), which moves the upper driving wheel away from the lower driving wheel when sealing the single-fold film, so as to reduce the tensioning exerted by the driving wheels on the single-fold film during the sealing step.

Although the pulling devices, comprising lifting actuators actuated by a specific external circuit for the distancing of the driving wheels (such as, for example, pistons controlled by electro-valves, fed by a pneumatic or hydraulic circuit), ensure the approaching/distancing of the driving wheels necessary for reducing the tensioning of the single-fold film during the packaging process, they involve undesirably high volume (due to the presence of the pumping system, which feeds the pneumatic/hydraulic piston, considerable costs (related to the use of electro-valves and to the sealing of the piston, etc.), and considerable complexity (due to the presence of two different power circuits: one for rotating the driving wheels and another for distancing them).

SUMMARY OF THE INVENTION

Therefore, it is an object of the present invention to supply an automatic packaging machine provided with a pulling device for the single-fold film having such features as to overcome at least some of the drawbacks of the prior art.

It is a particular object of the invention to provide a pulling device for the single-fold film, which bests conciliates the needs to reduce the complexity and volume thereof, at the same time, reducing the costs related to the arrangement of a specific power circuit (in detail, the compressed air of the pneumatic actuator).

These and other objects are achieved by means of an automatic packaging machine according to claim 1. The dependent claims relate to advantageous and preferred embodiments.

In accordance with one aspect of the invention, an automatic packaging machine comprises:

- an input conveyor belt, onto which the product (or group of products) intended for packaging is loaded;
- a reel holder, containing a single-fold film reel, which feeds the automatic packaging machine by unwinding a single-fold film;
- a film former having a contoured shape, which deploys the single-fold film, separating the two edges of single-fold film, originally folded one on top of the other, in order to wind it around the product to be packaged;
- a sealing bar, which seals the single-fold film around the product, by sealing the still-open sides of single-fold film;
- a collecting device for the scraps of single-fold film;
- an output conveyor belt, which moves the product away from the automatic packaging machine once the packaging has been completed;
- a pulling device for the single-fold film, comprising:
- at least two driving wheels, in particular, an upper driving wheel and a lower driving wheel, in contact with a layer of single-fold film interposed between the two driving wheels and which, rotating in opposite directions, move the single-fold film along the automatic packaging machine;
- a drive shaft, which transfers a rotational motion to the driving wheels, so that the driving wheels move the single-fold film along the automatic packaging machine;
- a lifting actuator, which moves the upper driving wheel away from the lower driving wheel (or vice versa) when sealing the single-fold film, so as to reduce the tensioning exerted by the driving wheels on the single-fold film during the sealing step;

characterized in that the lifting actuator is actuated by the drive shaft.

Due to the use of a lifting actuator actuated by the drive shaft, it is possible to obtain a film-pulling device capable of reducing the tensioning exerted by the driving wheels on the single-fold film during the sealing step, which is simple and reliable and which has lower volume and reduced costs. In fact, a lifting actuator, which is actuated by the drive shaft, eliminates the need to include a further specific power circuit within the pulling device, for the actuation of only the lifting actuator, which moves the driving wheels apart. The lifting actuator of the driving wheels of the invention, being fed by the same power source, which feeds the rotatory motion of the driving wheels themselves (in other words, the drive shaft) results in the construction of a simpler pulling device, with reduced volume and costs.

For a better understanding of the invention and to appreciate the advantages thereof, below is a description of various embodiments, given by way of non-limiting examples.

DETAILED DESCRIPTION OF THE INVENTION

With reference to the figures, an automatic packaging machine, according to the invention, is generally indicated with reference 1.

Figure 1A:
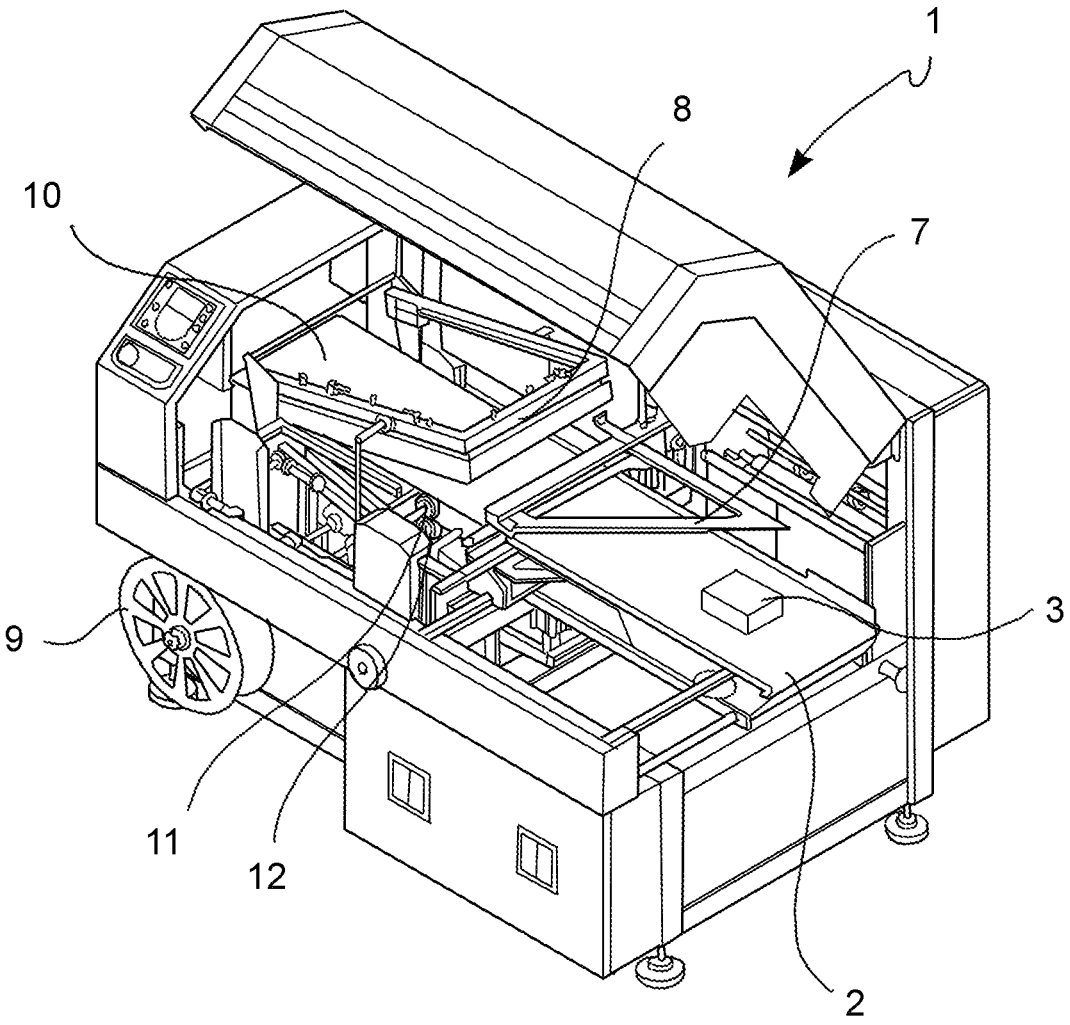
FIG. 1A is a front perspective view of an automatic packaging machine, according to one embodiment of the invention.
Figure 1B:
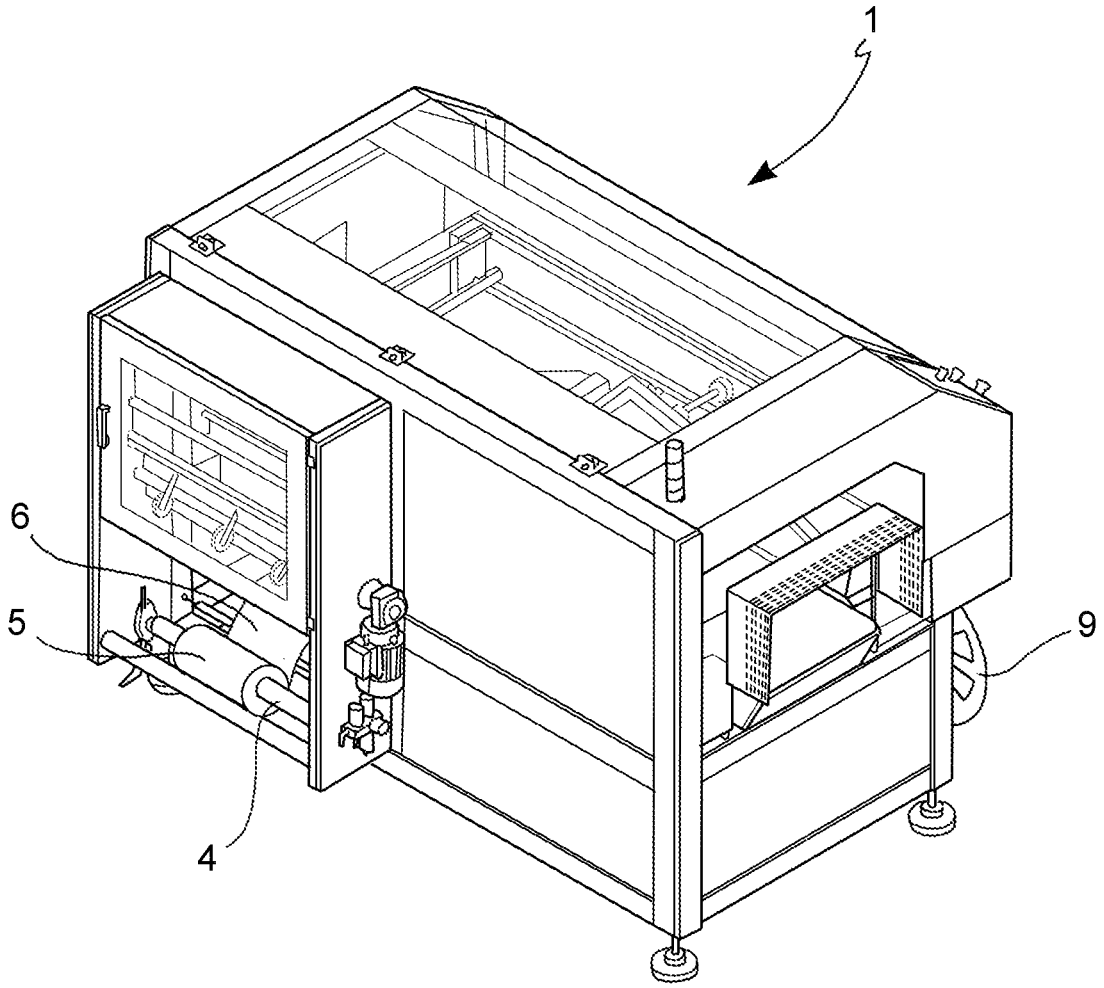
FIG. 1B is a rear perspective view of the automatic packaging machine in FIG. 1A.
Figure 2:
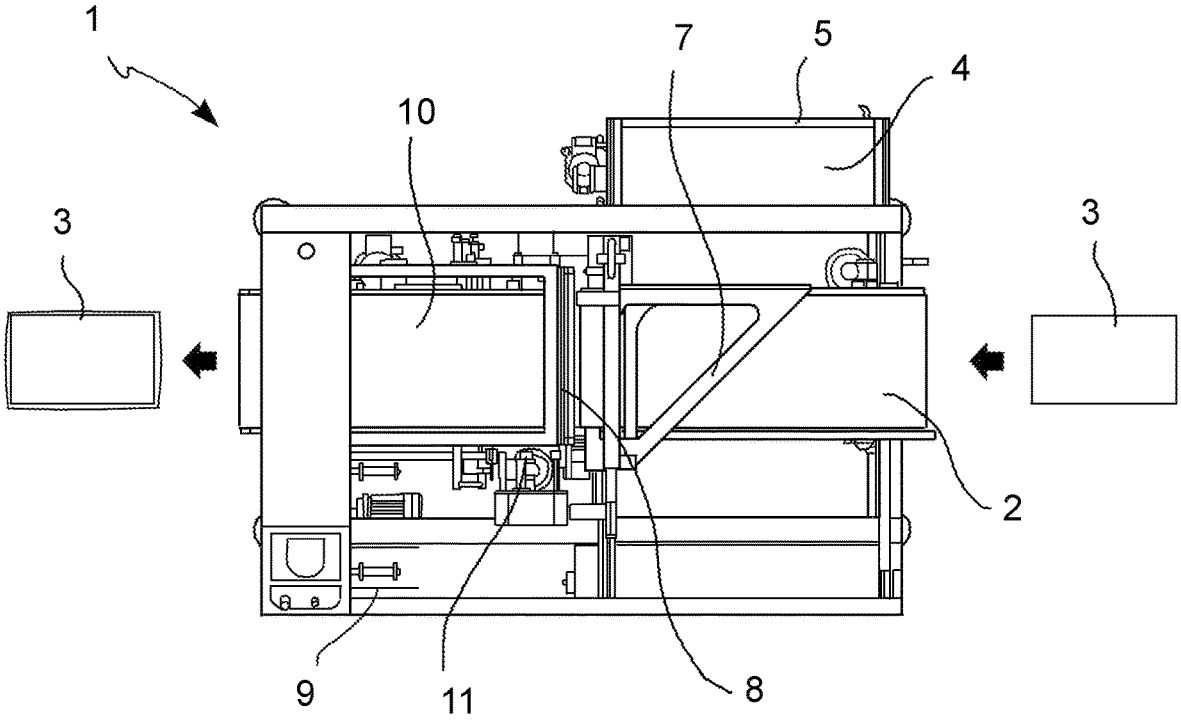
FIG. 2 is a view from above of the automatic packaging machine in FIGS. 1A and 1B.
Figure 3:
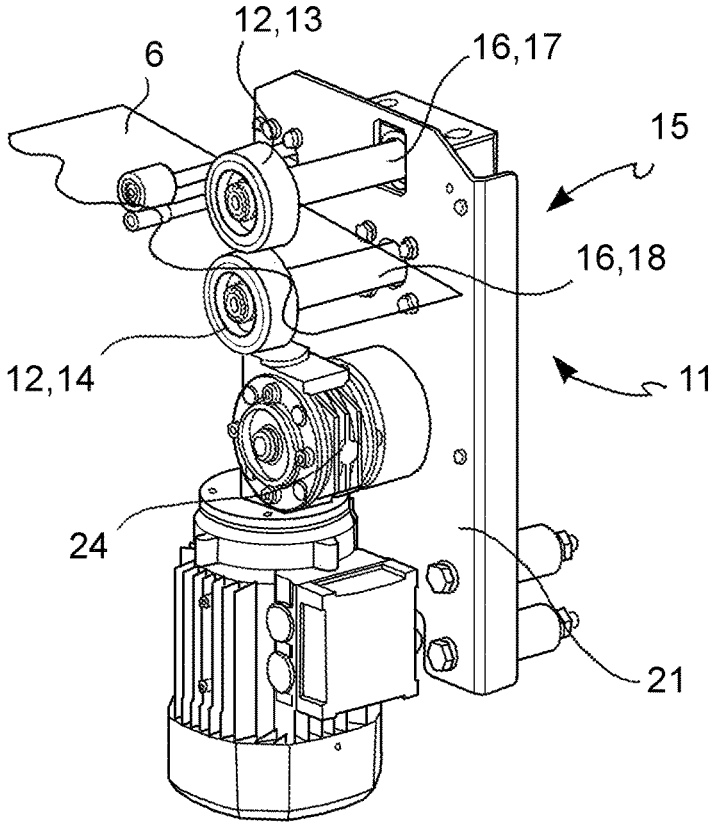
FIG. 3 is a partial front perspective view of the film pulling device, according to one embodiment of the invention.

The automatic packaging machine 1, or more simply the packaging machine 1, according to one embodiment of the invention (FIGS. 1A, 1B, 2) comprises an input conveyor belt 2 onto which a product 3 (or a group of products) intended for packaging is loaded.

The packaging machine further comprises a reel holder 4, containing a reel 5 of single-fold film, which feeds the packaging machine 1 by unwinding a single-fold film 6.

The single-fold film 6 is a type of film folded on itself along the side of the length.

The packaging machine 1 also comprises a film former having a contoured shape 7, which deploys the single-fold film 6, separating the two edges of single-fold film 6, originally folded one on top of the other, in order to wind it around the product 3 to be packaged.

Furthermore, a sealing bar 8 is present in the packaging machine 1, which seals the single-fold film 6 around the product 3, by sealing the still-open sides of single-fold film 6.

The packaging machine 1 further comprises a collecting device 9, in which the scraps of single-fold film 6, generated by the packaging process, are collected and deposited.

The packaging machine 1 also comprises an output conveyor belt 10, which moves the product 3 away from the packaging machine 1, once the packaging has been completed.

The packaging machine 1 also comprises a pulling device 11 for the single-fold film 6, which comprises at least two driving wheels 12, in particular, an upper driving wheel 13 and a lower driving wheel 14. The driving wheels 12 are in contact with a layer of single-fold film 6 interposed between the driving wheels 12. The driving wheels 12, rotating in opposite directions, move the single-fold film 6 along the packaging machine 1.

The packaging machine 1 also comprises a drive shaft 22, which transfers a rotational motion to the driving wheels 12, so that the driving wheels 12 move the single-fold film 6 along the automatic packaging machine 1.

In accordance with one feature of the invention, the pulling device 11 comprises a lifting actuator 15, which moves the upper driving wheel 13 away from the lower driving wheel 14, (or vice versa), when sealing the single-fold film 6, so as to reduce the tensioning exerted by the driving wheels on the single-fold film during the sealing step, wherein the lifting actuator 15 is actuated by the drive shaft 22.

By virtue of the use of an electric actuator 15, it is possible to obtain a single-fold film 6 pulling device 11 capable of reducing the tensioning exerted by the driving wheels 12 on the single-fold film 6 during the sealing step, which is simple and reliable, and which is characterized by reduced volume and lower costs.

According to one embodiment of the invention, the driving wheels 12 (preferably two), are fitted onto shafts 16. The shafts 16 are preferably two in number, in other words, an upper shaft 17 and a lower shaft 18. The upper driving wheel 13 is fitted onto the upper shaft 17, while the lower driving wheel 14 is fitted onto the lower shaft 18.

The upper shaft 17 is hinged onto an upper support block 19, while the lower shaft 18 is hinged onto a lower support block 20.

The lower support block 20 is fixed to a substantially planar surface 23 of a support frame 21.

The shafts 16 extend through the planar surface 23 substantially perpendicularly to said planar surface 23.

The support frame 21 also supports the drive shaft 22, which extends transversely to the planar surface 23, in a substantially perpendicular manner, and which transmits a rotatory motion from a convenient motorization 24, typically an electric motor, to one of the shafts 16, preferably the lower shaft 18.

In fact, a motor transmission wheel 25 is fitted to one end of the drive shaft 22 and rotates with the drive shaft 22.

Figure 4:
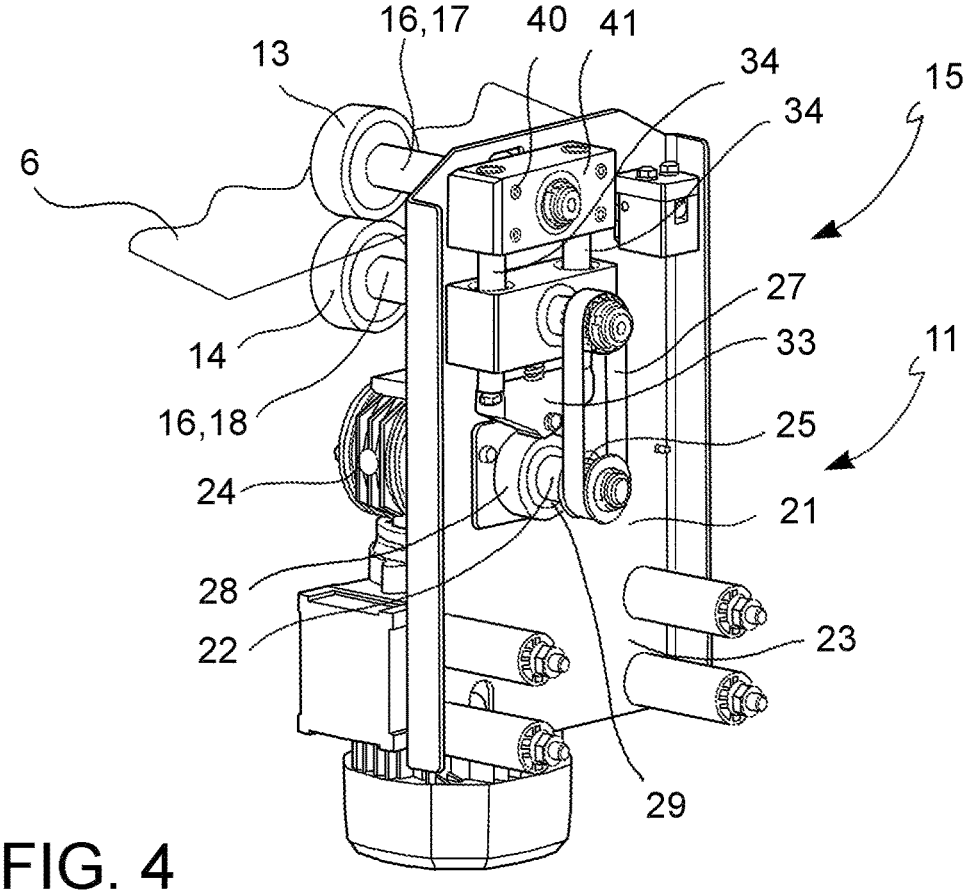
FIG. 4 is a partial rear perspective view of the film-pulling device according to the embodiment in FIG. 3.

The rotatory motion is transmitted from the drive shaft 22 to the lower shaft 18 by means of a transmission belt 27, which connects the motor transmission wheel 25 to the lower shaft 18 (FIG. 4).

The upper shaft 17, the lower shaft 18 and the drive shaft 22 are preferably aligned vertically along one same plane 26, perpendicular to the planar surface 23.

A lifting wheel 28 is also fitted to the drive shaft 22. The lifting wheel 28 is substantially cylindrical in shape. The lifting wheel 28 is connected to the drive shaft 22 by means of a unidirectional bearing 29.

In accordance with one aspect of the invention, the drive shaft 22 rotates in a given direction of rotation, transferring the rotating motion to the driving wheels 12 during the step of pulling the single-fold film 6 along the packaging machine 1. Whereas, at the time of the step of sealing the single-fold film 6, the drive shaft 22 rotates in the opposite direction, travelling a revolution length.

According to one embodiment of the invention, the drive shaft 22 rotates in an anti-clockwise direction during the single-fold film 6 pulling step, as it travels a revolution length, in a clockwise direction during the single-fold film sealing step.

The unidirectional bearing 29 is configured so as not to transmit the rotatory motion from the drive shaft 22 to the lifting wheel 28 during the single-fold film 6 pulling step (in other words, preferably, when the drive shaft 22 rotates in an anti-clockwise direction). Instead, during the sealing step (in other words, preferably, when the drive shaft 22 rotates in a clockwise direction) the unidirectional bearing 29 transmits the rotatory motion from the drive shaft 22 to the lifting wheel 28.

During the sealing, the unidirectional bearing 29 makes the lifting wheel 28 rotate by a revolution length together with the drive shaft 22.

Figure 6:
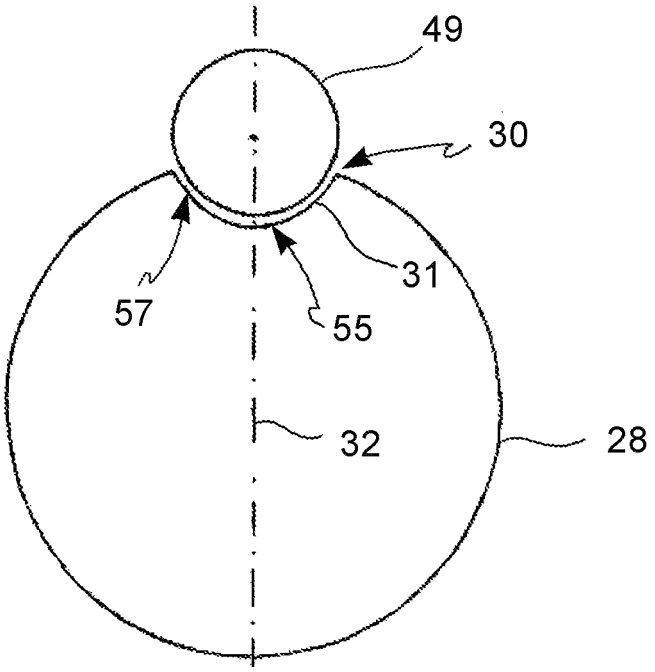
FIG. 6 is a schematic view of a detail of the film-pulling device during an operational step, according to one embodiment.
Figure 7:
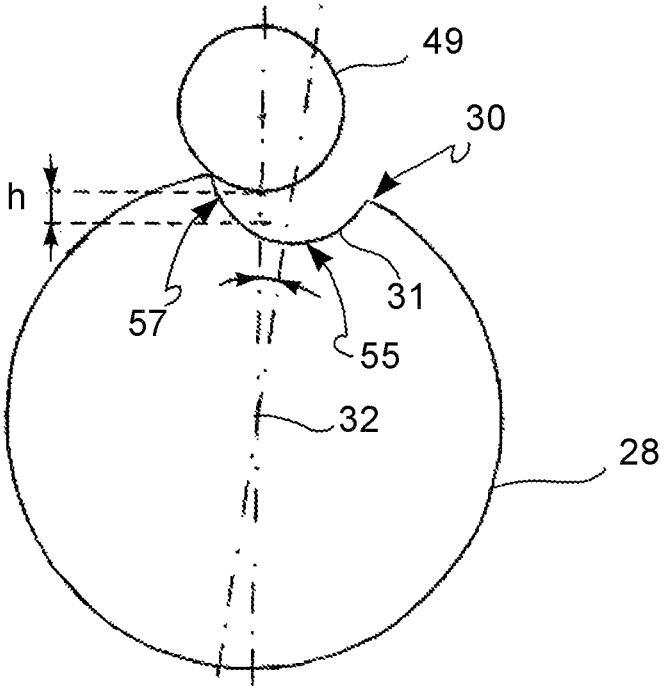
FIG. 7 is a schematic view of the detail in FIG. 6, during a different operational step.
Figure 8:
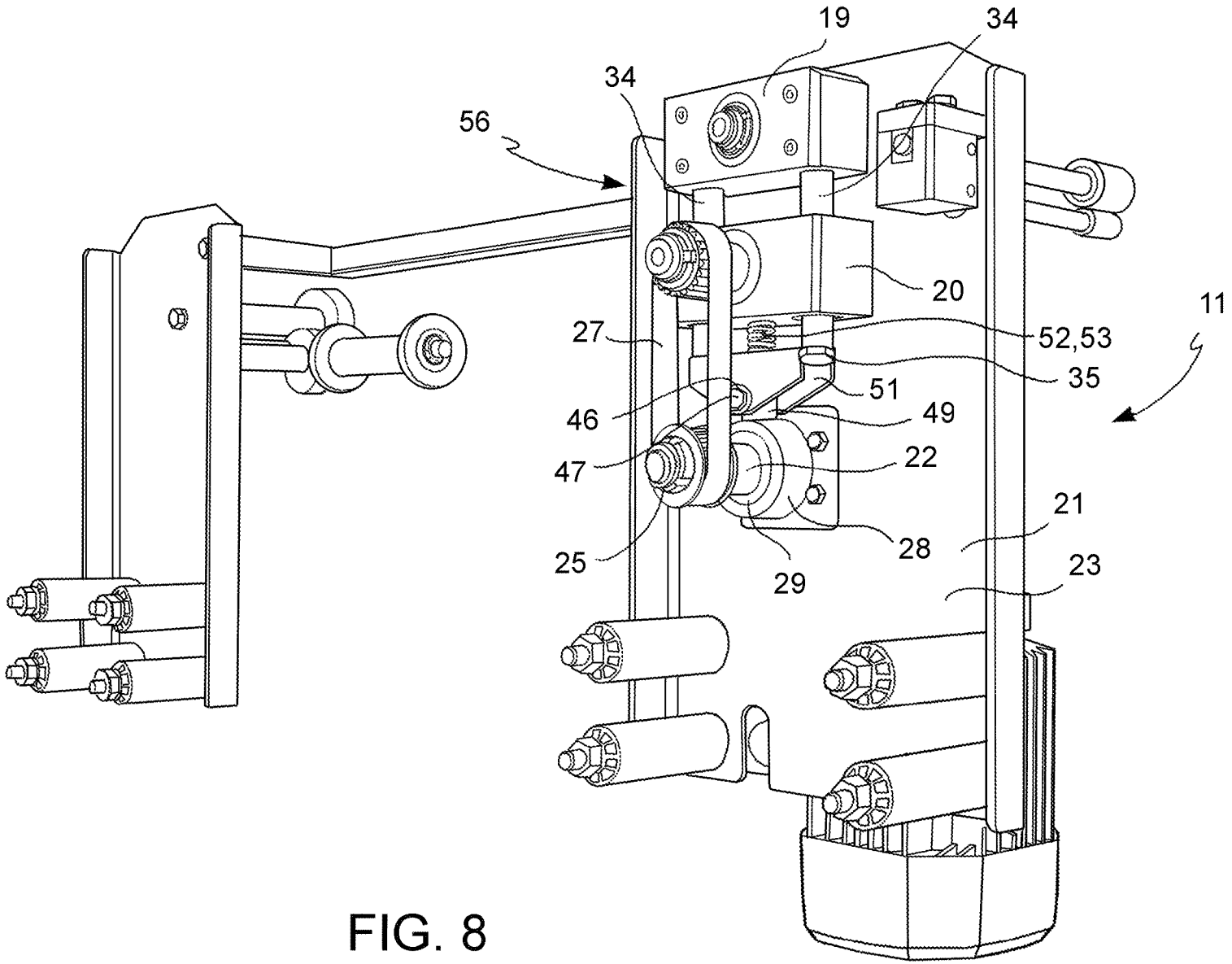
FIG. 8 is a partial rear perspective view of an automatic packaging machine, comprising a film-pulling device, according to one embodiment of the invention.
Figure 9:
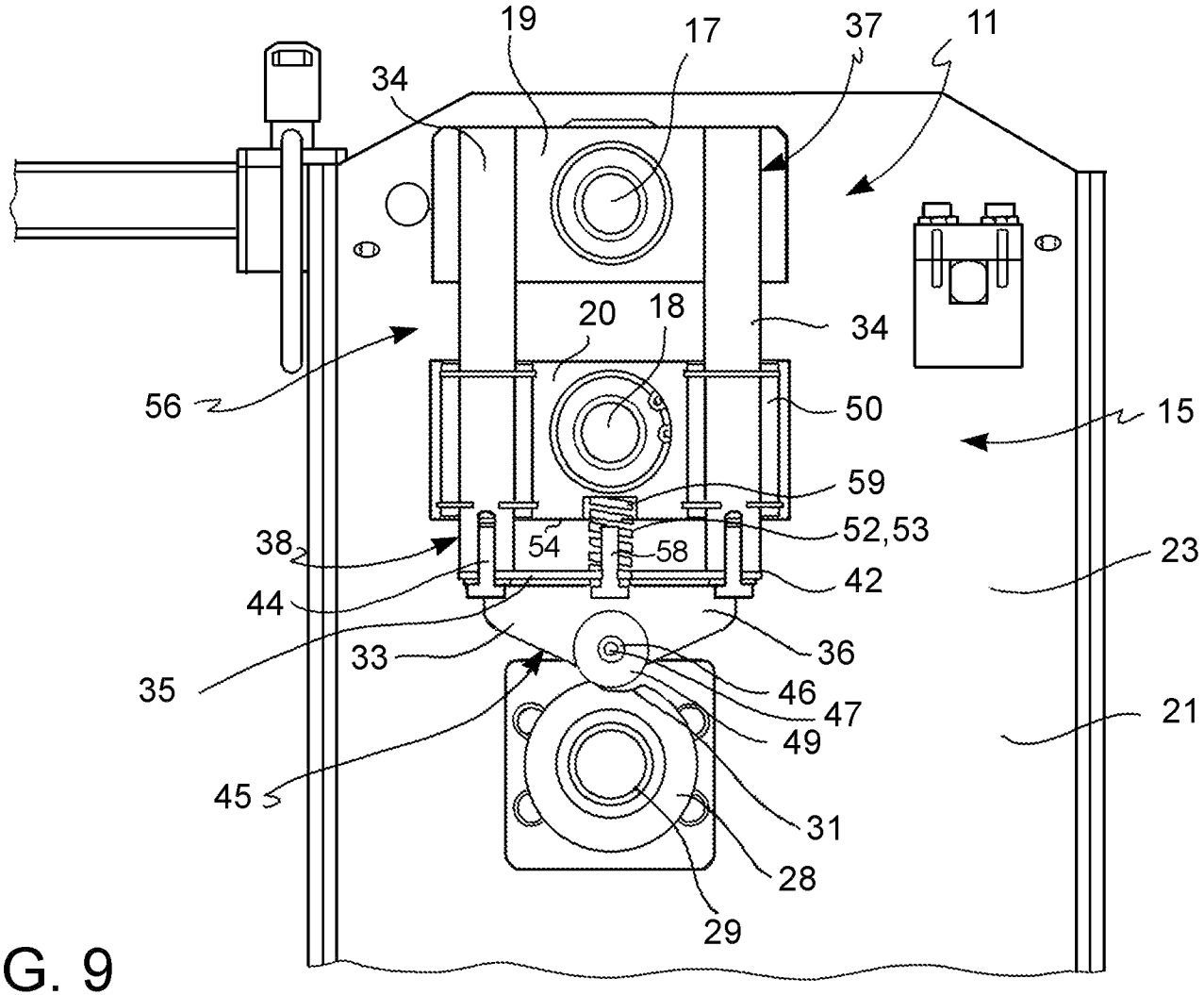
FIG. 9 is a partial cross-sectional view of the automatic packaging machine in FIG. 8, comprising the film-pulling device of the invention.

A seat 31 is formed on a peripheral area 30 of the lifting wheel 28, being convex in shape with respect to the center 32 of the lifting wheel 28 (FIGS. 6-7), so as to have an outward concavity.

The pulling device 11 further comprises a movable actuation element 33, which is connected to the upper support block 19, so as to be able to slide in a vertical direction between a lowered position and a raised position.

According to one embodiment, the movable actuation element 33 comprises a substantially rectangular-shaped base 35, from which preferably substantially triangular-shaped plates 36 extend downwards. Preferably, the rectangular base 35 and the plates 36 form one single piece.

A coupling wheel 49 is firmly connected to the movable actuation element 33.

According to one preferred embodiment, a slot 46 is formed at a top area 45 of the plates 36, and at one same distance from the rectangular base 35, inside which slot 46 a rod 47 is firmly fixed, extending through the two slots 46, and in a central portion of the rod 47, said central portion being comprised between the two triangular plates, there is fitted the coupling wheel 49. The coupling wheel 49 is firmly fixed to the rod 47, preferably by means of interference.

According to one embodiment of the invention, the radius of the coupling wheel 49 is smaller than the distance between the slots 46 and the rectangular base 35, so that the coupling wheel 49 is contained inside an internal space 51 formed by the triangular plates 46 and the rectangular base 45.

The actuation element 33 is firmly connected to the upper support block 19 by means of connecting posts 34, preferably two connecting posts 34.

The upper end portion 37 of the connecting posts 34 is fixed to the upper support block 19, and a lower end portion 38 of the connecting posts 34 is fixed to the actuation element 33.

Figure 5:
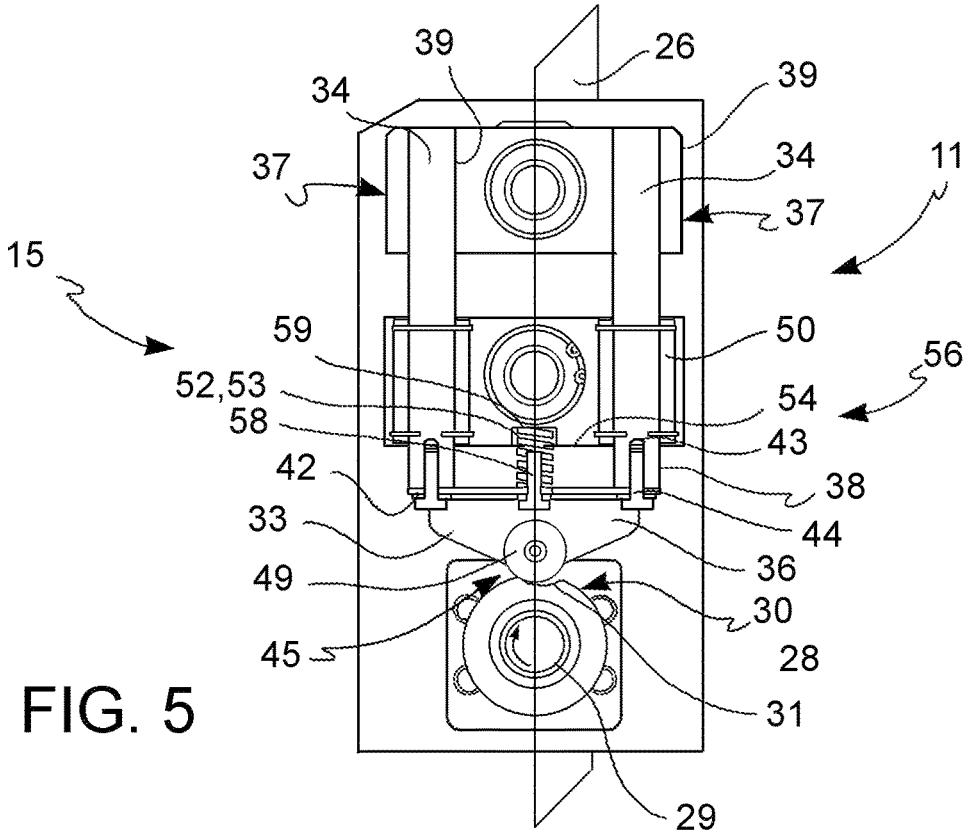
FIG. 5 is a rear cross-sectional view of the film-pulling device in FIG. 4.

According to one preferred embodiment, the upper end portion 37 of the connecting posts 34 is fixed to the upper support block 19 by means of a hub-shaft connection, wherein the upper end portion 37 of the connecting posts 34 is inserted into guides 39 formed in the upper support block 19 and fixed to the upper support block 19 by interference and/or by means of a plurality of pins 40 inserted through a rear surface 41 of the upper support block 19, penetrating the upper support block 19 and the upper end portion 37 of the connecting posts 34 (FIGS. 4-5).

According to one further preferred embodiment, the lower end portion 38 of the connecting posts 34 is fixed to the actuation element 33 by means of a bolting made between the rectangular base 35 of the actuation element 33 and a lower base 45 of the lower end portion 38 of the connecting posts 34, onto which holes 43 are formed, into which bolts 44 are inserted, which cross and connect the rectangular base 35 and the lower base 45 of the actuation posts 33.

According to one further preferred embodiment, the connecting posts 34, which connect the upper support block 19 to the actuation element 33, are inserted through through-guides 50 formed in the lower support block 20. The through-guides 50 preferably being ball-recirculating sleeves with small clearance. Therefore, according to this embodiment, the lower support block 20 is interposed between the upper support block 19 and the actuation element 33.

This configuration, wherein the connecting posts 34, which connect the upper support block 19 to the actuation element 33, slide inside special through-guides 50, formed in the lower support block 20, allows a reduction in the volume outside the lower support block 20, thus reducing the volume of the pulling device 11 as a whole.

In accordance with one aspect of the invention, the actuation element 33 and the lower support block 20 are connected by means of an elastic element 52, for example, a compression spring 53.

According to one embodiment of the invention, one end of the compression spring 53 is connected to the rectangular base 35 of the actuation element 33, while another end of the compression spring 53 is connected to a lower plane 54 of the lower support block 20, wherein the lower plane 54 is facing the rectangular base 35 and parallel thereto.

Preferably, the end of the compression spring 53 connected to the lower plane 54 of the lower support block 20 is inserted in a seat 59 formed on the lower plane 54.

According to one further embodiment of the invention, the compression spring 53 is inserted around a support pin 58 fixed to the actuation element 33. The support pin 58 provides the compression spring 53 with greater resistance to buckling.

In accordance with one aspect of the invention, the single-fold film 6 pulling device 11 is configured so that the coupling wheel 49 rests on the seat 31 formed on the lifting wheel 28. Therefore, the pulling device 11 is configured so that a component set 56 comprising the upper driving wheel 13, the upper support block 19, the connecting posts 34, the actuation element 33 and the coupling wheel 49 rests on the seat 31 of the lifting wheel 28.

According to one preferred embodiment, the pulling device 11 is configured so that during the pulling of the single-fold film 6 along the packaging machine 1, the coupling wheel 49 rests in a central area 55 of the seat 31.

During the pulling of the single-fold film 6 by the driving wheels 12, the unidirectional bearing 29 does not transfer the rotatory motion of the drive shaft 22 to the lifting wheel 28. Consequently, during the pulling of the single-fold film 6, the lifting wheel 28 and the component set 56 resting on the seat 31 stay still.

Instead, during the sealing step, when the drive shaft 22 rotates by a revolution length in the opposite direction of rotation, the unidirectional bearing 29 transfers this rotation to the lifting wheel 28, which thus rotates by a revolution length. By turning by a revolution length, the coupling wheel 49 comes into contact with a peripheral area 57 of the seat 31 that pushes the coupling wheel 49 and the actuation element 33 towards the lower support block 20, by means of the shape of the seat 31, thus, at the same time, pushing the upper support block 19 (firmly connected to the actuation element 33 by means of the connecting posts 34) to a greater distance from the lower support block 20, generating the distancing of the upper driving wheel 13 from the lower driving wheel 14.

During the sealing step, the lifting wheel 28 stays still, overcoming the thrust of the spring 53.

Figure 10:
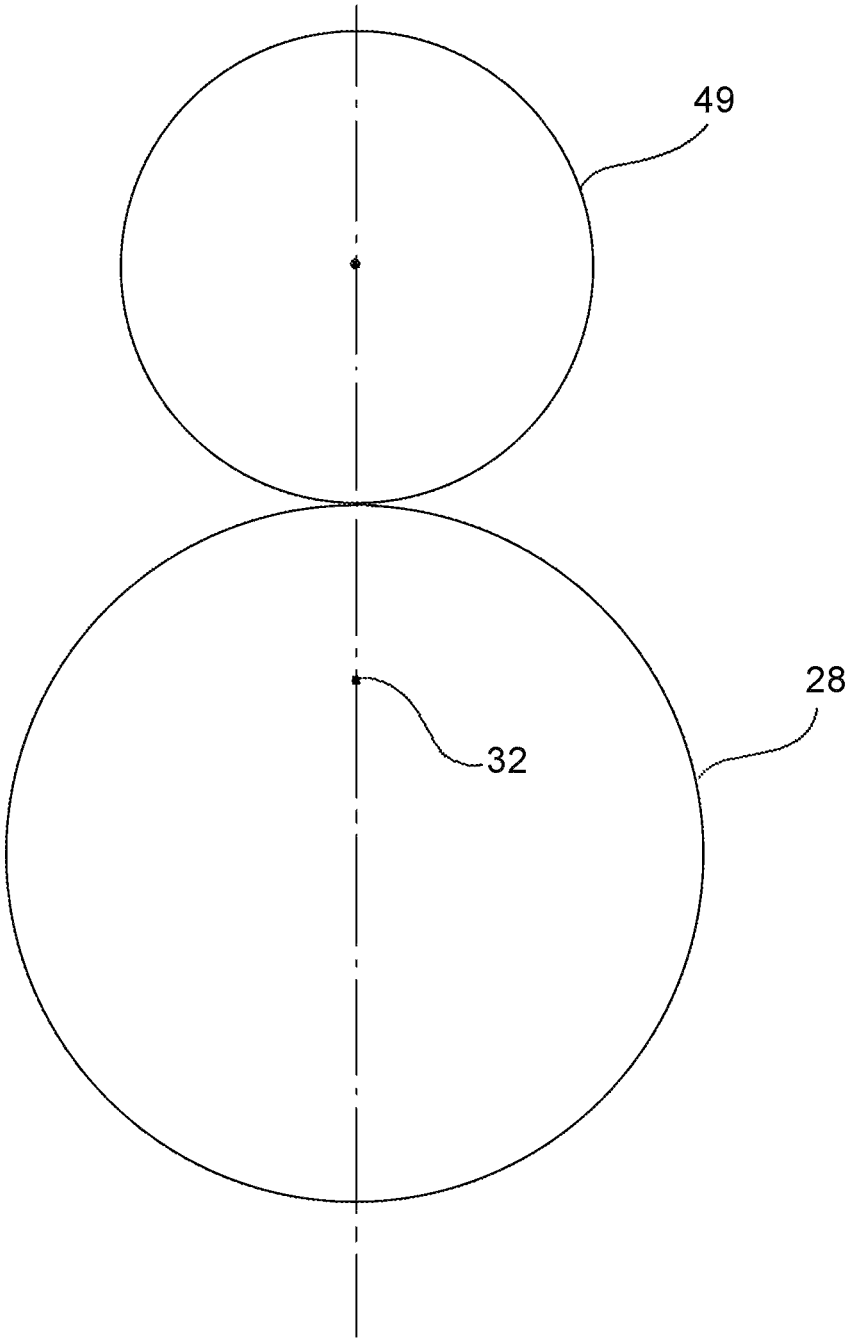
FIG. 10 is a schematic view of a detail of the film-pulling device, according to a further embodiment, during an operational step.
Figure 11:
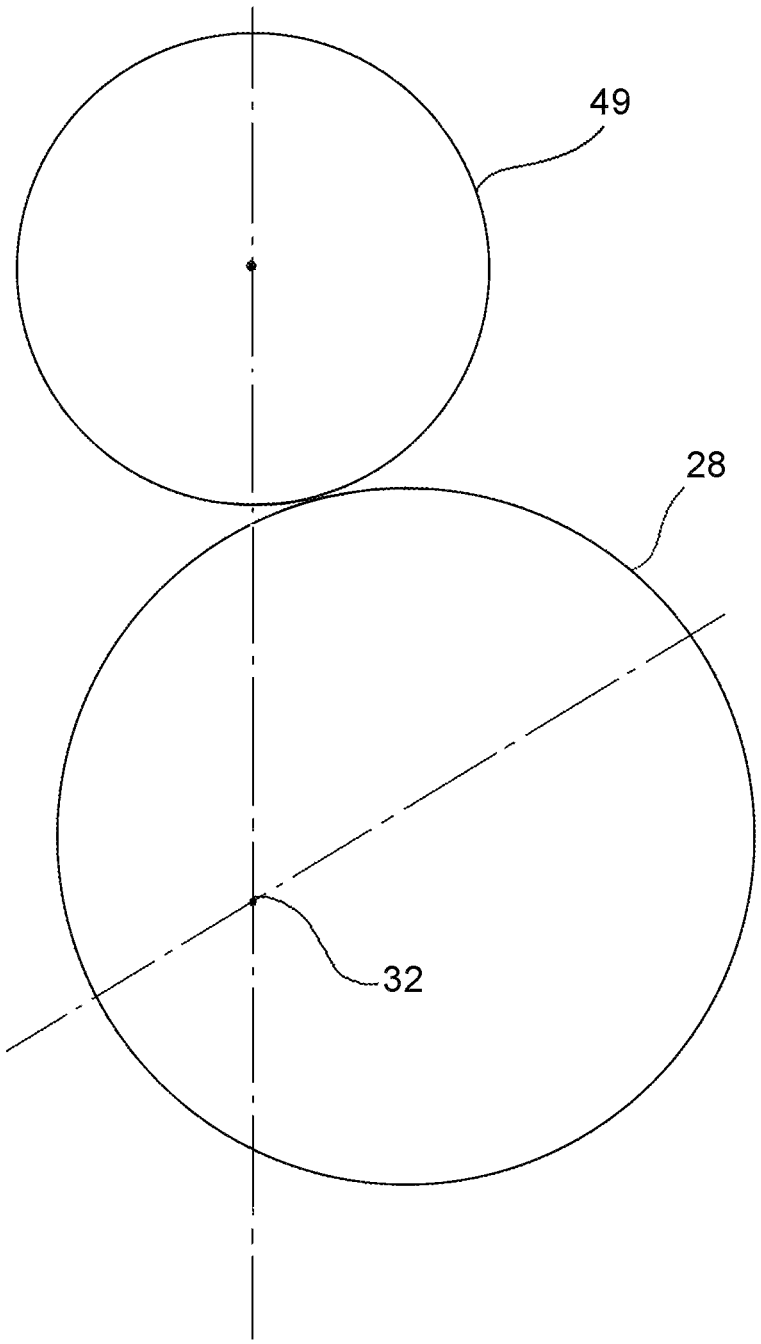
FIG. 11 is a schematic view of the detail in FIG. 10, during a different operational step.

According to one further embodiment of the invention (FIGS. 10-11), the pulling device 11 of the single-fold film 6 is configured so that the coupling wheel 49 rests on a lifting wheel 28, wherein the lifting wheel 28 is an eccentric wheel, so that a component set 56, comprising the upper driving wheel 13, the upper support block 19, the connecting posts 34, the actuation element 33 and the coupling wheel 49 rests on the lifting wheel 28. By rotating a revolution length during the sealing step, the eccentric lifting wheel 28 pushes the coupling wheel 49 and the component set 56 upwards.

The return of the positioning of the wheel 49 is carried out in the following manner. Upon termination of the film sealing step, the motor starts to rotate again in the pulling direction, in the example, in an anti-clockwise direction, thus, with the unidirectional bearing 29 not exerting any force on the wheel 49 due to the thrust of the spring 53, the coupling wheel 49 returns to the initial position thereof, in the concave part of the housing seat 31.

In order to satisfy specific, contingent needs, a person skilled in the art can make further modifications and variations, all comprised within the protective scope defined by the claims.

What we claim is:

1. An automatic packaging machine, comprising:

an input conveyor belt onto which a product intended for packaging is loaded;

a reel holder containing a single-fold film reel which feeds the automatic packaging machine by unwinding a single-fold film;

a film former having a contoured shape, which deploys the single-fold film by separating two edges of the single-fold film, originally folded one on top of the other, in order to wind it around the product to be packaged;

a sealing bar which seals the single-fold film around the product by sealing still-open sides of the single-fold film;

a collecting device, in which scraps of the single-fold film, generated by a packaging process, are collected and deposited;

an output conveyor belt which moves the product away from the automatic packaging machine once packaging has been completed; and a device for pulling the single-fold film, comprising:

two driving wheels comprising an upper driving wheel and a lower driving wheel in contact with a layer of the single-fold film interposed between the two driving wheels, wherein the upper and lower driving wheels rotate in opposite directions to move the single-fold film along the automatic packaging machine;

a drive shaft, which transfers a rotational motion to the driving wheels, so that the driving wheels move the single-fold film along the automatic packaging machine; and a lifting actuator, which moves the upper driving wheel away from the lower driving wheel or vice versa when sealing the single-fold film, so as to reduce tensioning exerted by the driving wheels on the single-fold film during a sealing step;

wherein the lifting actuator is actuated by the drive shaft.

2. The packaging machine according to claim 1, wherein:

the driving wheels are fitted onto shafts, the shafts comprise an upper shaft and a lower shaft, the upper driving wheel is fitted onto the upper shaft, and the lower driving wheel is fitted onto the lower shaft, the upper shaft is hinged onto an upper support block, and the lower shaft is hinged onto a lower support block, the lower support block is fixed to a planar surface of a support frame, the upper and lower shafts extend across the planar surface perpendicularly to said planar surface, and the support frame supports the drive shaft, which extends transversely to the planar surface in a perpendicular manner and which transmits a rotary motion from an electric motor to one of the upper and lower shafts.

3. The packaging machine according to claim 1, wherein a lifting wheel is fitted onto the drive shaft, wherein the lifting wheel is connected to the drive shaft by means of a unidirectional bearing, and wherein the drive shaft is configured to rotate in a given rotation direction, thus transferring the rotational motion to the driving wheels during a step of pulling the single-fold film along the packaging machine, and to rotate in a direction opposite to the given rotation direction, thus travelling a revolution length during the sealing step.

4. The packaging machine according to claim 3, wherein the unidirectional bearing is configured:

not to transmit the rotational motion from the drive shaft to the lifting wheel during the step of pulling the single-fold film; and to transmit the rotational motion from the drive shaft to the lifting wheel during the sealing step.

5. The packaging machine according to claim 3, wherein a seat is formed on a peripheral area of the lifting wheel, the seat being convex in shape with respect to a center of the lifting wheel, so that it has an outward facing concavity.

6. The packaging machine according to claim 3, wherein the lifting wheel is eccentric, so that a component set, comprising the upper driving wheel, an upper support block, connecting posts, an actuating element, and a coupling wheel, rests on the lifting wheel.

7. The packaging machine according to claim 2, wherein the device for pulling further comprises a movable actuating element which is connected to the upper support block and which slides in a vertical direction between a lowered position and a raised position.

8. The packaging machine according to claim 7, wherein the actuating element is firmly connected to the upper support block by means of two connecting posts.

9. The packaging machine according to claim 8, wherein the connecting posts are inserted through through-guides formed in the lower support block, said through-guides being ball-recirculating sleeves with small clearance, wherein the lower support block is interposed between the upper support block and the actuating element.

10. The packaging machine according to claim 7, wherein the actuating element and the lower support block are connected by means of an elastic element.

11. The packaging machine according to claim 6, wherein the coupling wheel is firmly connected to the actuating element.

12. The packaging machine according to claim 5, wherein the device for pulling is configured so that a coupling wheel rests on the seat formed on the lifting wheel, and so that a component set, comprising the upper driving wheel, an upper support block, connecting posts, an actuating element, and the coupling wheel, rests on the seat of the lifting wheel.

13. The packaging machine according to claim 12, wherein the device for pulling is configured so that, when pulling the single-fold film along the packaging machine, the coupling wheel rests in a central area of the seat.

* * * * *